US005694646A

United States Patent [19]

Roberts

[11] Patent Number: 5,694,646

[45] Date of Patent: Dec. 9, 1997

[54] PROTECTIVE GARMENT FOR CARETAKERS

[76] Inventor: Timothy J. Roberts, 1375 Michelle Ct., Schaumberg, Ill. 60173

[21] Appl. No.: 571,648

[22] Filed: Dec. 13, 1995

[51] Int. Cl.[6] ..... A41D 13/00; A41D 27/00; A41D 27/20

[52] U.S. Cl. ..... 2/114; 2/46; 2/48; 2/69; 2/247; 165/46; 165/DIG. 44; 607/96; 607/108; 607/114

[58] Field of Search ..... 2/2, 46, 48, 49.1, 2/49.2, 49.3, 49.4, 49.5, 50, 51, 52, 69, 69.5, 75, 80, 115, 94, 114, 247, 208, 249, 250, 251, 252, 253, 125, 126, 400, 406; 126/205, 204, 203.01; 165/46, DIG. 44, DIG. 46, DIG. 47; 607/96, 108, 109, 110, 111, 112, 114

[56] References Cited

U.S. PATENT DOCUMENTS

| | | | |
|---|---|---|---|
| 3,868,728 | 3/1975 | Krzewinski | 2/114 |
| 4,555,811 | 12/1985 | Shimalla | 2/114 |
| 4,625,729 | 12/1986 | Roney | 607/108 |
| 4,756,311 | 7/1988 | Francis, Jr. | 126/204 X |
| 4,837,860 | 6/1989 | Roberts et al. | 2/51 |
| 5,031,244 | 7/1991 | Inagaki | 2/94 X |
| 5,156,867 | 10/1992 | Norvell | 2/114 X |
| 5,195,187 | 3/1993 | Yang | 2/247 X |
| 5,291,617 | 3/1994 | Moretz et al. | 2/406 |
| 5,335,372 | 8/1994 | Wiedner et al. | 2/125 X |
| 5,361,412 | 11/1994 | Perry | 2/247 |
| 5,380,826 | 1/1995 | Castor et al. | 530/422 |
| 5,491,844 | 2/1996 | Kehl et al. | 2/49.1 |

*Primary Examiner*—Jeanette E. Chapman
*Attorney, Agent, or Firm*—Henry S. Layton

[57] ABSTRACT

A system of protective garments for caretakers is disclosed. The system provides for comfortable garments to protect medical or nursing personnel while they are attending patients. The system includes a outter garment having a outter layer which is impervious to fluids and an inner liner that is comfortable to the wearer. A vest like garment is provided to be worn under the outter garmant and hold heat exchanger devices to cool the wearer. The system is designd to be disposable, however some of the elements may be reused if they have not come in contact the patients.

6 Claims, 3 Drawing Sheets

FIG. 7

FIG. 1
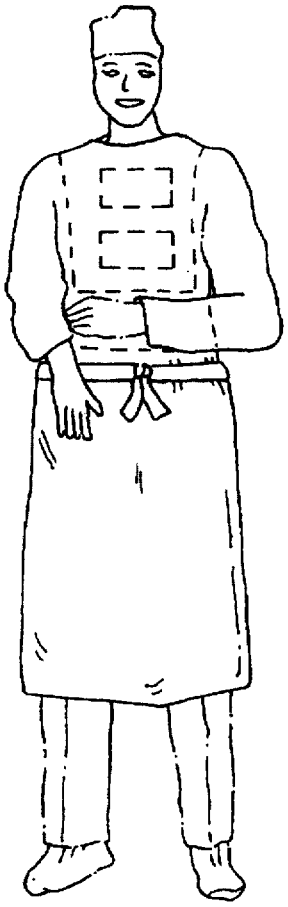
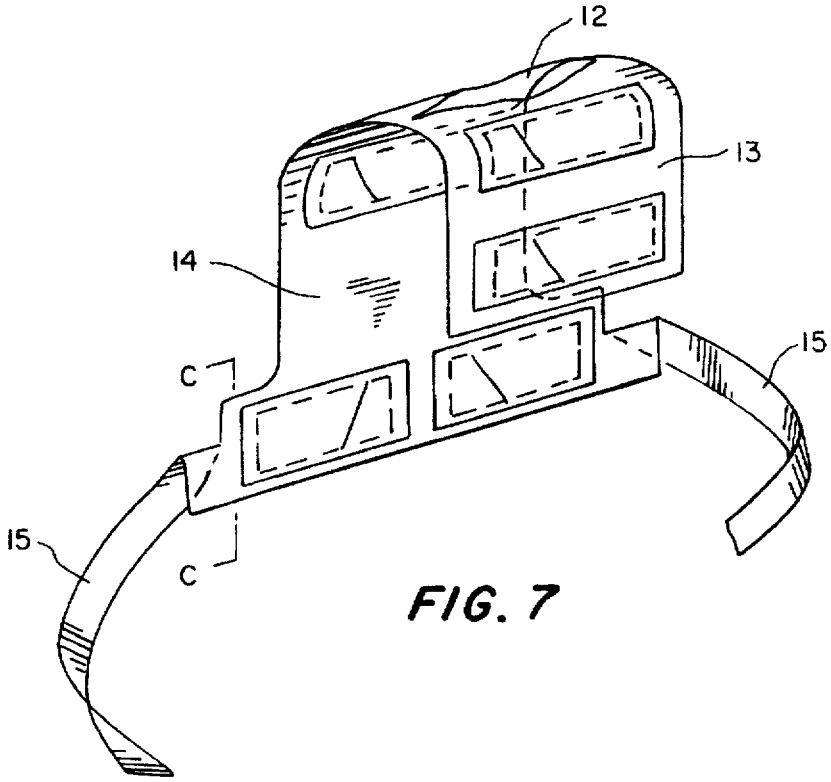
FIG. 7

PROTECTIVE GARMENT FOR CARETAKERS

BACKGROUND OF THE INVENTION

Medical personnel have long used protective garment that prevent them from transmitting germs to patients. With the advent of the AIDS virus and other contagious deseases, it is important to protect the medical caretakers from cross infections. Most outer garments worn by medical personnel can be penetrated by fluids and do not provide the protection desired. Garments made impervious to fluids are devised from material that that prevents air penetration as well, and the resulting lack of air circulation within the garment leads to excessive build-up of body heat when the wearer works under stress for a long period of time, often amid hot lights, with no opportunity to let his or her body "breathe." The current invention effectively protects the caregiver and has the significant advantage of providing for their comfort by overcomming the build-up of body heat that occurs within a garment impervious to air. It provides for cooling the body within the garment.

OBJECTS OF THE INVENTION

The objects of the invention are to provide a comfortable garment to protect medical or nursing personnel while they are attending patients. The garment should be easy to put on and take off, thus be quickly changable between patients. It should be inexpensive enough to be disposable. It should fit persons of any stature.

Such a garment would need an outer layer impervious to fluids and an inner liner comfortable to the wearer. The current invention provides for a layer of non-woven material and additional possibilities for body cooling through pockets in the garment into which can be placed heat exchangers in the form of removable packets of medically "safe" material that can be frozen, thawed in use and then be reused simply by re-freezing.

Adding to the comfort of the wearer, the invention further contemplates an independent vest-like garment made of non-woven material with pockets containing heat exchangers. This inner "cooling" garment need not be changed between patients as required of the outer garment.

Another object of the invention would be to provide a protective system with as many disposable components as economically possible combining them with elements that are reusable over a longer period of time.

DRAWINGS

In the drawings:

FIG. 1 shows the overall system of a caretakers garment providing protection and comfort to the wearer.

FIG. 7 is an isometric view of the optional vest with heat exchangers.

Figure 8:
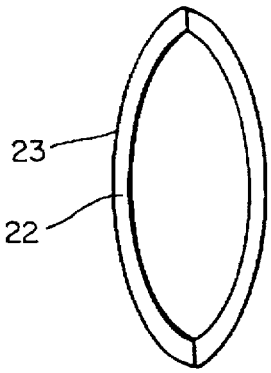

FIG. 8 a section view along the lines C—C of of FIG. 7.

Figure 9:
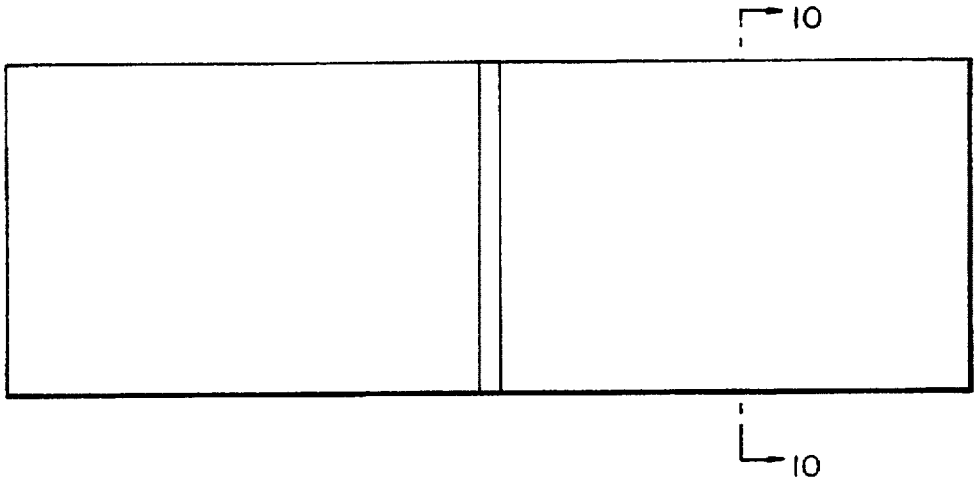

FIG. 9 is a plan view of the heat exchanger of the invention.

Figure 10:
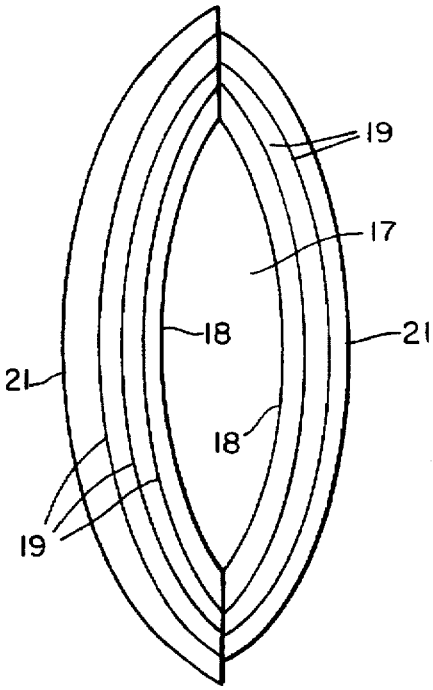

FIG. 10 is a section view along the lines D—D of FIG. 9.

DESCRIPTION

Figure 2:
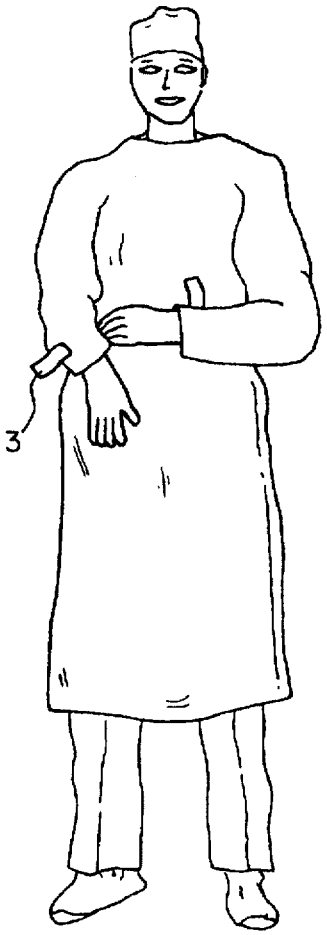
FIG. 2 is a general showing of the outer garment.

The garments of the current invention include an apron-type gown as disclosed in applicant's previous U.S. Pat. No. 4,837,860. Added to that gown are a thin layer of polyethylene and a layer of non-woven polyproplene in the upper body area as seen in FIG. 2. These layers of material are bonded togather at a seam 8. The non-woven material provides a comfortable lining to the garment and will wick moisture away from the wearer. The thin polyethylene layer is used as a moisture barrier and to provide a pocket for the optional insertion of heat exchangers to add to the wearability of the garment. This garment, as described in the previously-cited patent, is easily donned and designed for disposability between patients.

This protective system is further enhanced through a vest-like garment that can hold heat exchangers comfortably close to the body; this garment need not be disposed of between patients, but can be worn effectively for several hours and then either disposed of and/or renewed for wearing a multiple number of times.

This vest-like inner garment, as shown in FIG. 7, is made of two layers of non-woven polypropylene, having sealed between them two layers of thin polyethylene OCT. The exterior polypropylene is used as a comfort layer to be worn next to the body or undergarments; the polyethylene provides sealed pockets that can hold heat exchangers in several places close to the body. The vest is designed to be open on the sides as seen in FIG. 7 for easy donning, with tie strings to be tied to hold the vest in place.

The heat exchangers, as shown in FIG. 9, consist of a water solution contained in sealed polypropylene envelopes. The preferred embodiment is two rectangular-shaped containers separated by a seal, so as to provide flexibility when frozen. The polyethylene envelope is to be covered on one side with three layers of non-woven polyproylene and only one layer on the other side, as shown in FIG. 10. The purpose of the multilple layers is to provide a difference in thermal effectiveness and provide for condensation absorbtion. For applications where less cooling is desirable, the heat exchangers should be inserted with the multiple layers toward the body.

In use, the heat exchanger envelope is covered with a layer of polyethylene OCT to guard against accidental leakage. The solution within the heat exchange envelope is bacteriologically filtered water with a trace of CLOROX. This solution has been tested and proved to be biologically safe after long periods of containment. This means that, though accidental spillage of the solution is improbable, the liquid would still be harmless in case of an inadvertent piercing of its polyethylene container.

DETAILED DESCRIPTION

Figure 4:
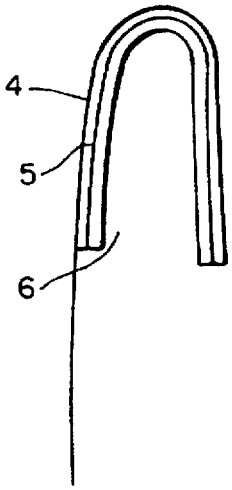
FIG. 4 is section view along the lines A—A of FIG. 3.
Figure 5:
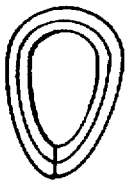
FIG. 5 is a section view along the lines B—B of FIG. 3.

The disclosed protective garment system includes an apron-type gown which is designed to be donned over the head and with the arms extended into the sleeves an shown in FIG. 2. There is a adhesive tab provided at 3 to hold sleeve tight for the the insertion in a glove. The disclosed gown made up of layers of material as shown by the FIGS. 4 and 5 taken along the lines A—A and B—B for FIG. 3. The outer layer 4 extends from mid back, over the shoulders and to the knees. This layer is made of a impervious material such as polyethylene. In the preferred embodyment this layer is embosed and has color added for appearence value. A layer 5 of thin polyethylene is added to the upper portion for the gown. An inner layer 6 of soft non-woven polypropylene is provided as the interior of the gown. The same construction for the sleeve is shown in FIG. 5. These layers are heat sealed togather along the seam at 7 and 8.

The gown thus formed provides a barrier impervious to body fluids from the outside, a thin layer to provide pocket to contain condensation and allow comfortable movement between the non-woven polypropylene inner layer. The inner layer is soft, absorbs moisture and is comfortable to the wearer.

In one embodyment the heat-exchangers of FIG. 9 may be placed between the outer layer on the thin polyethylene in the sleeve area at 9 or slid into the chest area 10 to provide for cooling of the wearer.

Figure 3:
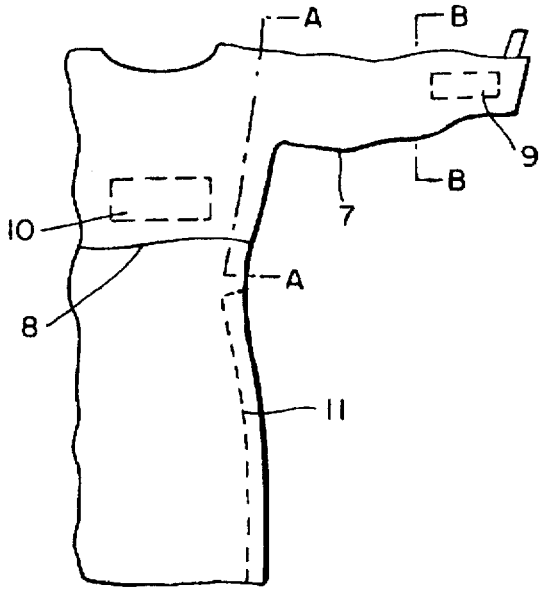
FIG. 3 shows the construction details of the outer garment.
Figure 6:
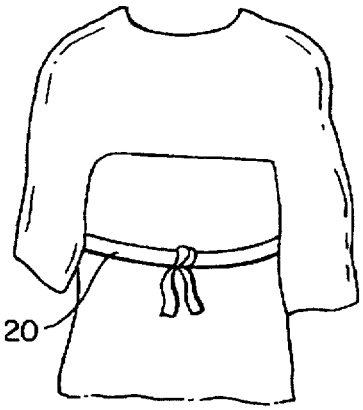
FIG. 6 is a back view of FIG. 1.

As shown at 11 in FIG. 3 the edge of the outer layer is weakened so it may be torn off and used as tie to hold the gown in place. The tie is shown at 20 in FIG. 6.

Additional features of gown are noted as being easy to put on and take off, fitting persons of any stature and made of inexpensive material so as to be disposable between patients.

To further enhance the comfort of caregivers in long procedures where heat build up can be a problem, the invention provides an independant vest-like garment to be worn under the gown. This garment, as shown in FIG. 7, is made of an outside layer of non-woven polypropylene 23 and has heat sealed between them two layers of thin polyethylene 22. A cross section showing this construction is shown in FIG. 8. The vest is designed to be eaisly put on by putting the head through the neck opening 12 and allowing the front portion 13 to cover the chest and the back is covered by the portion 14. The waist portion is provided with longer portions to wrap around the waist of the wearer and ties are provided at 15.

Pockets are provided for heat exchangers by heat sealing a portion of the vest togather and cutting an opening for access. In the perfered embodyment, pockets are provided in the lower and upper front section 13 and in the upper portion of the back 14. The waist area is provided with a pocket at each end.

To complete the protective system, a heat exchanger is provided for insertion in the garments. The heat exchanger shown in FIGS. 9 and 10. The heat exchanger consists of envelope of frozen material. In the perferred embodyment a heavy polyethylene envelope has a medically safe solution sealed in two compartments. The object of the two compartments is to provide flexability of the pack when frozen.

The polyethylene envelope is covered on one side by three layers of non-woven polypropylene and by only one layer of the now-woven material on the other side. The whole envelope is then covered by another layer of impervious polyethylene to provide an additional seal.

The purpose of the multiple layers it to provide a different amount of cold to be transmitted from each side of the pack. The side with the multiple layers will be considered the cool side, to be placed next to the wearer for comfort. Should the wearer feel he needs more cooling, the heat exchanger may be placed with the cold side, the one with only one layer of non-woven materal, next to the body. The cool and cold sides could be indicated by using different colors for the outside covers.

FIG. 10 shows a cross section of the heat exchanger taken along lines D—D of FIG. 9. The medically safe for en solution is noted at 17. The heavy inner seal is at 18. The multiple layers of non-woven material are shown at 19. The tough outer layer is noted at 21. The layer 21 may be colored to indicate which side is coldest.

The heat exchangers are completely reusable. Once they have thawed, ie, lost all the cold, they may be refrozen for reuse or they may be discarded. The vest is designed for multiple use, with several changes of heat exchangers, or it may be discarded daily or after each patient. The gown is designed to be discarded after each patient.

A system of protective garments for the use of medical caregivers has been discribed. In use, the outer gown will provide protection from contamination with its impervious layer. This layer would be discarded after each patient. The system also includes a vest like garment to be worn under the gown and can hold the third element of the system, the heat exchangaers, which provide for a variable amount of cooling.

Having fully described the system, what is claimed is:

1. A multiple layered disposable protective garment of the over the head type having full sleeves, a long front portion and an open mid-length extending back comprising:

an outer layer of impervious material;

a middle layer of light weight waterproof material;

an inner layer of soft non-woven hydrophilic material;

all layers heat sealed together along the sleeve sides and across the front portion;

wherein the area between the outer layer and the middle form a pocket open at the sleeve ends for removeablely holding heat exchangers for the comfort of the wearer.

2. A garment as in claim 1 wherein the sleeves are provided with adhesive strips for closing them around the wearer's wrists.

3. A garment as in claim 1 wherein a waist tie is provided by a tear-off strip on the sides of the long front portion of the outer layer.

4. In combination a heat exchanger, a vest having an opening for the wearers head, open sides, a front portion, a rear portion and tie strings attached to the back portion for wrapping and fastening and fastening at the wearers waist;

said front, rear and waist portions are made of two layers of impervious material sandwiched between two layers of soft hydrophilic non-woven material:

said vest having multiple pockets in each of said front, rear and waist portions for removablely holding heat exchangers for the comfort of the wearer.

5. The vest of claim 4 wherein the pockets are formed by heat sealing the layers together in a rectangular shape at places where the pocket are desired and cutting an opening through the outer two layers.

6. A system of protective garments for the use of caregivers in a warm environment comprising:

a heat exchanger;

an over the head type garment made of layers of material including an outer layer of impervious material, a middle layer of thin impervious material and a inside layer of soft non-woven hydrophilic material;

an opening between the middle and inside layer to provide a pocket for the insertion of a heat exchanger;

wherein an opening for said wearers head, open sides, a front portion, a rear portion and tie strings attached to the back portion for wrapping and fastening at the wearers waist and the front, rear and waist portions are made of two layers of impervious material sandwiched between two layers of soft hydrophilic non-woven material.

* * * * *